US005389503A

United States Patent [19]

Evans et al.

[11] Patent Number: 5,389,503

[45] Date of Patent: Feb. 14, 1995

[54] PHOTOGRAPHIC ELEMENTS FOR PRODUCING BLUE, GREEN, AND RED EXPOSURE RECORDS OF THE SAME HUE

[75] Inventors: Gareth B. Evans, Potten End; Christopher B. Rider, Mitcham Surrey; Michael J. Simons, Eastcote, all of England

[73] Assignee: Eastman Kodak Company, Rochester, N.Y.

[21] Appl. No.: 198,415

[22] Filed: Feb. 22, 1994

Related U.S. Application Data

[62] Division of Ser. No. 93,509, Jul. 16, 1993, Pat. No. 5,350,651.

[51] Int. Cl.[6] ..... G03C 1/46

[52] U.S. Cl. ..... 430/502; 430/503; 430/506

[58] Field of Search ..... 430/502, 503, 506, 507, 430/508, 510, 511, 517

[56] References Cited

U.S. PATENT DOCUMENTS

| | | | |
|---|---|---|---|
| 4,542,091 | 9/1985 | Sasaki et al. | 430/507 |
| 4,543,308 | 9/1985 | Schumann et al. | 430/21 |
| 4,777,102 | 10/1988 | Levine | 430/21 |
| 4,788,131 | 11/1988 | Kellogg et al. | 430/394 |
| 5,158,865 | 10/1992 | Harder et al. | 430/517 |

*Primary Examiner*—Charles L. Bowers, Jr.
*Assistant Examiner*—Geraldine Letscher
*Attorney, Agent, or Firm*—Carl O. Thomas

[57] ABSTRACT

A method is disclosed of obtaining from an imagewise exposed photographic element separate records of the imagewise exposure to each of the blue, green and red portions of the spectrum comprising photographically processing an imagewise exposed photographic element comprised of a sequence of superimposed blue, green and red recording silver halide emulsion layer units that produce images of the same hue upon processing. A first interlayer overlies the emulsion layer unit nearest the support for transmitting to it imagewise exposing radiation this emulsion layer unit is intended to record and for absorbing after photographic processing scanning radiation within at least one wavelength region. A second interlayer underlies the emulsion layer unit farthest from the support for transmitting to the underlying emulsion layer units exposing radiation they are intended to record and for absorbing after photographic processing scanning radiation within at least one wavelength region. The imagewise exposed photographic element is photographically processed to produce a reflective image in each of the emulsion layer units and is reflection scanned utilizing the absorption of the first and second interlayers to provide the image information in two of the emulsion layer units. The photographic element is scanned through the interlayers and all of the emulsion layer units to provide a spectrally undifferentiated third record of the combined images in all of the emulsion layer units. The first, second and third records are compared to obtain separate blue, green and red exposure records. In the photographic elements of the invention the interlayers remain or become light absorbing after photographic processing.

6 Claims, No Drawings

PHOTOGRAPHIC ELEMENTS FOR PRODUCING BLUE, GREEN, AND RED EXPOSURE RECORDS OF THE SAME HUE

This is a divisional of U.S. application Ser. No. 093,509, filed Jul. 16, 1993, U.S. Pat. No. 5,350,651.

FIELD OF THE INVENTION

The invention is directed to a method of extracting blue, green and red exposure records from an imagewise exposed silver halide photographic element and to a photographic element particularly adapted for use in the method.

BACKGROUND

In classical black-and-white photography a photographic element containing a silver halide emulsion layer coated on a transparent film support is imagewise exposed to light, producing a latent image within the emulsion layer. The film is then photographically processed to transform the latent image into a silver image that is a negative image of the subject photographed. Photographic processing involves developing (reducing silver halide grains containing latent image sites to silver), stopping development, and fixing (dissolving undeveloped silver halide grains). The resulting processed photographic element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In classical color photography in its most widely used form the photographic film contains three superimposed silver halide emulsion layer units each containing a different subtractive primary dye or dye precursor, one for recording blue light (i.e., blue) exposure and forming a yellow dye image, one for recording green exposure and forming a magenta dye image, and one for recording red exposure and forming a cyan dye image. During photographic processing developing agent is oxidized in the course of reducing latent image containing silver halide grains to silver, and the oxidized developing agent is employed to form the dye image, usually by reacting (coupling) with a dye precursor (a dye-forming coupler). Undeveloped silver halide is removed by fixing and the unwanted developed silver image is removed by bleaching during photographic processing. This approach is most commonly used to produce negative dye images (i.e., blue, green and red subject features appear yellow, magenta and cyan, respectively). Exposure of color paper through the color negative followed by photographic processing produces a positive color print.

Although widely used this form of classical color photography has evolved highly complicated complementary film and paper constructions. For example, a typical color negative film contains not only a minimum of three different emulsion layer units, but also dye-forming couplers, coupler solvents to facilitate their dispersion, masking couplers to minimize image hue distortions in printing onto color paper, and oxidized developing agent scavengers to avoid formation of unwanted dyes. Not only is the film structure complex, but the optical qualities of the film are degraded by the large quantities of ingredients related to dye image formation and management.

A much simpler film that has enjoyed commercial success in classical color photography is a color reversal film that contains three separate emulsion layer units for separately recording blue, green and red exposures, but contains no dye image forming ingredients. The film is initially processed like a black-and-white photographic film to produce three separate silver images in the blue, green and red recording emulsion layer units. The simplicity of construction has resulted in imaging properties superior to those of incorporated dye-forming coupler color negative films.

The factor that has limited use of these color reversal films is the cumbersome technique required for translating the blue, green and red exposure records into viewable yellow, magenta and cyan dye images. Three separate color developments are required to sequentially form dye images in the blue, green and red recording emulsion layer units. This is accomplished in each instance by rendering the silver halide remaining after black-and-white development developable in one layer and then employing a color developer containing a soluble dye-forming coupler to develop and form a dye image in one of the emulsion layer units. Developed silver is removed by bleaching to leave three reversal dye images in the photographic film.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a near infrared beam, relying on developed silver to modulate the beam. Another approach is to address areally the black-and-white negative relying on modulated transmission to a CCD array for image information recording. In color photography blue, green and red scanning beams are modulated by the yellow, magenta and cyan image dyes. In a variant color scanning approach the blue, green and red scanning beams are combined into a single white scanning beam modulated by the image dyes that is read through red, green and blue filters to create three separate records. The records produced by image dye modulation can then be read into any convenient memory medium (e.g., an optical disk). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print at will. Alternatively, the image can be viewed as a video display or printed by a variety of techniques beyond the bounds of classical photography—e.g., xerography, ink jet printing, dye diffusion printing, etc.

A number of other film constructions have been suggested particularly adapted for producing photographic images intended to be extracted by scanning:

Kellogg et al U.S. Pat. No. 4,788,131 extracts image information from an imagewise exposed photographic element by stimulated emission from latent image sites of photographic elements held at extremely low temperatures. The required low temperatures are, of course, a deterrent to adopting this approach.

Levine U.S. Pat. No. 4,777,102 relies on the differential between accumulated incident and transmitted light during scanning to measure the light unsaturation remaining in silver halide grains after exposure. This approach is unattractive, since the difference in light unsaturation between a silver halide grain that has not been exposed and one that contains a latent image may be as low as four photons and variations in grain saturation can vary over a very large range.

Schumann et al U.S. Pat. No. 4,543,308 relies upon differentials in luminescence in developed color films to provide an image during scanning. Relying on differentials in luminescence from spectral sensitizing dye, the preferred embodiment of Schumann et al, is unattractive, since luminescence intensities are limited. Increasing spectral sensitizing dye concentrations beyond optimum levels is well recognized to desensitize silver halide emulsions.

SUMMARY OF THE INVENTION

This invention has as its purpose to provide a method of extracting from a silver halide color photographic element independent image records representing imagewise exposures to the blue, green and red portions of the visible spectrum without forming dye images. More particularly, the invention is concerned with achieving this objective using color photographic film and photographic processing that are simplified as compared to that required for classical color photography.

The present invention eliminates any need for dye image forming features in the photographic element construction. Further, the processing of the photographic elements is comparable to the simplicity of classical black-and-white photographic processing. Equally as important is that the simplifications can be realized by remaining within the bounds of proven film construction, processing and scanning capabilities.

In one aspect the invention is directed to a method of obtaining from an imagewise exposed photographic element separate records of the imagewise exposure to each of the blue, green and red portions of the spectrum comprising (a) photographically processing an imagewise exposed photographic element comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support and an intermediate emulsion layer unit located between the first and last emulsion layer units, and (b) obtaining separate blue, green and red exposure records from the photographic element, wherein (c) the photographic element is additionally comprised of, interposed between the first emulsion layer unit and the intermediate emulsion layer unit, a first interlayer for transmitting to the first emulsion layer unit electromagnetic radiation this emulsion layer unit is intended to record and for absorbing after photographic processing scanning radiation within at least one wavelength region and, interposed between the last emulsion layer unit and the intermediate emulsion layer unit, a second interlayer for transmitting to the intermediate and first emulsion layer units electromagnetic radiation these emulsion layer units are intended to record and for absorbing after photographic processing scanning radiation within at least one wavelength region, (d) the imagewise exposed photographic element is photographically processed to produce a reflective image in each of the emulsion layer units, (e) the photographic element is reflection scanned utilizing the absorption of the first and second interlayers to provide a first record of the image information in one of the first and last emulsion layer units and a second record of the image information in one other of the emulsion layer units, (f) the photographic element is scanned through the first and second interlayers and all of the emulsion layer units within a wavelength region to which the first and second interlayers are transmissive to provide a third record representing a combination of images in all of the emulsion layer units, and (g) the first, second and third records are compared to obtain separate blue, green and red exposure records.

In another aspect this invention is directed to a photographic element comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support, and an intermediate emulsion layer unit located between the first and last emulsion layer units, and a first interlayer coated between the first emulsion layer unit and the intermediate emulsion layer unit capable of transmitting to the first emulsion layer unit electromagnetic radiation this emulsion layer unit is intended to record and a second interlayer coated between the intermediate emulsion layer unit and the last emulsion layer unit capable of transmitting to the first and intermediate emulsion layer units electromagnetic radiation these emulsion layer units are intended to record, wherein the first and second interlayers each contain a dye or a precursor of a dye capable of absorbing after photographic processing scanning radiation within at least one wavelength region.

DESCRIPTION OF PREFERRED EMBODIMENTS

The invention is directed to a method of obtaining from an imagewise exposed photographic element containing separate emulsion layer units to provide records of imagewise exposure to each of the blue, green and red portions of the spectrum. The photographic element is photographically processed to produce images of the same hue corresponding to blue, green and red exposures. Extraction and differentiation of the blue, green and red exposure image information is made possible by the selection of interlayers between the emulsion layer units of specifically chosen light transmission and absorption characteristics and by employing scanning techniques that make use of these interlayer transmission and absorption characteristics to obtain at least one of the image records by reflection scanning. A second of the image records also can be obtained separately by reflection scanning in one form of the invention. In another form of the invention the second image record is obtained by reflection scanning producing a scanning record that is a combination of the image in the emulsion layer unit scanned and determined separately and the image in another emulsion layer unit. In this latter instance the first image record is mathematically extracted from the scanning record that is a combination of the first and second images to obtain the second image record. The third image record is obtained by producing a scanning record of all of the emulsion layer units in the photographic element and mathematically extracting the image contributions of the two emulsion layer units obtained by reflection scanning to differentiate the third exposure record. The invention also extends to constructions of the interlayer containing photographic elements useful in the practice of the method.

The basic features of the invention can be appreciated by considering the construction and use of a multicolor photographic element satisfying Structure I:

| |
|---|
| 3rd Emulsion Layer Unit |
| 2nd Interlayer |
| 2nd Emulsion Layer Unit |
| 1st Interlayer |
| 1st Emulsion Layer Unit |
| Photographic Support |

STRUCTURE I

The first, second and third emulsion layer units are each chosen to record imagewise exposure in a different one of the blue, green and red portions of the spectrum. Each emulsion layer unit can contain a single silver halide emulsion layer or can contain a combination of silver halide emulsion layers for recording exposures within the same region of the spectrum. It is, of example, common practice to segregate emulsions of different imaging speed by coating them as separate layers within an emulsion layer unit. The emulsion layer units can be of any convenient conventional construction. In a specifically preferred form the emulsion layer units correspond to those found in conventional color reversal photographic elements lacking an incorporated dye-forming coupler—i.e., they contain negative-working silver halide emulsions, but do not contain any image dye or image dye precursor.

The first interlayer interposed between the first and second emulsion layer units is constructed to transmit electromagnetic radiation that the first emulsion layer unit is intended to record and to absorb after photographic processing scanning radiation within at least one wavelength region. Similarly, the second interlayer interposed between the second and third emulsion layer units is constructed to transmit electromagnetic radiation that the first and second emulsion layer units are intended to record and to absorb after photographic processing scanning radiation within at least one wavelength region.

When the emulsion layer units intended to record minus blue (green or red) lack sufficient native blue sensitivity to require protection from blue light during imagewise exposure, six coating sequences of blue, green and red recording emulsion layer units are possible. Assigning the following descriptors:

IL1=first interlayer,
IL2=second interlayer,
B=blue recording emulsion layer unit,
G=green recording emulsion layer unit,
R=red recording layer unit, and
S=support, all of the following layer order sequences are contemplated: B/IL2/G/IL1/R/S, B/IL2/R/IL1/G/S, G/IL2/R/IL1/B/S, R/IL2/G/IL1/B/S, G/IL2/-B/IL1/R/S and R/IL2/B/IL1/G/S. Silver chloride and silver chlorobromide emulsions exhibit such negligibly low levels of native blue sensitivity that all conventional emulsions of these grain compositions can be employed without taking steps to protect the green or red recording emulsion layer units of these silver halide compositions from blue light exposure. Kofron et al U.S. Pat. No. 4,439,520 has demonstrated that adequate separation of blue and minus blue exposures can be achieved with tabular grain silver bromide or bromoiodide emulsions without protecting the minus blue recording layer units from blue light exposure.

The transmission and absorption characteristics required for the first and second interlayers during imagewise exposure can now be appreciated by considering the layer order sequences individually. Although imagewise exposure through the support of the photographic elements is in theory possible, the descriptions that follow are based on exposing radiation first striking the third emulsion layer unit, since opaque and antihalation layer containing supports preclude exposure through the support in most preferred photographic element constructions.

(LS-1)

B/IL2/G/IL1/R/S

In this layer sequence IL1 must be capable of transmitting red light and IL2 must be capable of transmitting green and red light during imagewise exposure. When G and R exhibit negligible native blue sensitivity, there is no requirement that IL1 or IL2 be capable of absorbing light of any wavelength during imagewise exposure. When G and R contain silver bromide or bromoiodide emulsions, it is preferred that at least IL2 and, most preferably, both IL1 and IL2 be capable of absorbing blue light during imagewise exposure.

(LS-2)

B/IL2/R/IL1/G/S

In this layer sequence IL1 must be capable of transmitting green light, otherwise the description above for LS-1 is fully applicable.

(LS-3)

G/IL2/R/IL1/B/S

In this layer sequence IL1 must be capable of transmitting blue light and IL2 must be capable of transmitting blue and red light during imagewise exposure. In this arrangement G exhibits negligible native blue sensitivity. When R exhibits negligible native blue sensitivity, there is no requirement that IL2 be capable of absorbing light of any wavelength during imagewise exposure. When R contains a silver bromide or bromoiodide emulsion, it is preferred that IL2 be capable of absorbing blue light during imagewise exposure.

(LS-4)

R/IL2/G/IL1/B/S

In this layer sequence the G and R silver halide selection criteria are reversed from those described for LS-3 to reflect the interchanged positions of these emulsion layer units and IL2 must transmit green and blue light, but otherwise the description above for LS-3 is fully applicable.

(LS-5)

G/IL2/B/IL1/R/S

In this layer sequence IL1 must be capable of transmitting red light and IL2 must be capable of transmitting blue and red light during imagewise exposure. In this arrangement G exhibits negligible native blue sensitivity. When R exhibits negligible native blue sensitivity, there is no requirement that IL1 be capable of absorbing light of any wavelength during imagewise exposure. When R contains a silver bromide or bromoiodide emulsion, it is preferred that IL1 be capable of absorbing blue light during imagewise exposure.

(LS-6)

R/IL2/B/IL1/G/S

In this layer sequence the G and R silver halide selection criteria are reversed from those described for LS-5 to reflect the interchanged positions of these emulsion layer units and IL2 must transmit green and blue light, but otherwise the description above for LS-5 is fully applicable.

Following imagewise exposure the photographic element is photographically processed to develop silver halide to silver as a function of exposure. When the emulsions are negative-working emulsions, as is preferred, silver halide grains containing latent image formed by light exposure within their spectral region of sensitivity are reduced to silver (Ag°) during development. How photographic processing proceeds following the developing step depends on whether the reflectance of developed silver or the reflectance of residual silver halide grains is to be employed for image retrieval during scanning. In classical color photographic element processing both developed silver and residual silver halide are removed from the photographic element during processing to leave a dye image. This is achieved by bleaching the developed silver and fixing out the silver halide sequentially or concurrently in a bleach-fix (blix) bath. The most common approach is to rehalogenate the developed silver to silver halide and then to fix out all silver halide.

In the preferred form of the invention residual silver halide grains remaining after development are relied upon to provide the reflectances required for the subsequent scanning steps. In one form of the invention developed silver is retained in the film. This offers the advantage of simplifying processing and allowing the relatively higher levels of light absorption by the developed silver to assist in image definition. Alternatively, the developed silver can be removed. This can be achieved by employing any convenient conventional non-rehalogenating type bleach. An illustration of a bleach of this type is a dichromate type bleach (e.g., 12 g/l sulfuric acid and 9.5 g/l potassium dichromate). Since the processed photographic elements are not fixed, unnecessary exposure to light prior to scanning is to be avoided. It is, of course, possible to introduce into the emulsion layer units desensitizers and/or stabilizers to minimize the possibility of post-processing printout. However, scanning can be accomplished without objectionable printout in the absence of such precautions.

When developed silver is relied upon for reflectance, any conventional nonbleaching fix bath can be employed. Although the light absorption of silver is relatively high throughout the visible spectrum and hence its reflectance is relatively low, Ag° has the advantage of exhibiting reflectances and absorptances that show relatively little variance as a function of the scanning wavelengths chosen.

At the conclusion of photographic processing the element contains three separate photographic images, an image representing a blue exposure record, an image representing a green exposure record, and an image representing a red exposure record. All of the images are formed by developed silver or residual silver halide and are therefore of essentially the same hue.

One of the significant features of this invention is the scanning approach used to obtain three differentiated blue, green and red image records. It has been discovered that two reflection scans and a third overall scan that can be either a reflection or transmission scan, depending on the element support structure, can be selected to produce three different scan records from which the blue, green and red image records can be obtained.

All of the scans are conducted within spectral wavelength regions in which the silver halide grains or silver remaining in the photographically processed element are reflective and the vehicle of the emulsion layer units is transmissive. The term "vehicle" is used to mean all of the nonreflective components of the emulsion layer units—principally peptizer and binder. It is generally convenient to conduct each of the scans within an overall wavelength range of from 300 to 900 nm, which extends from the near ultraviolet through the visible portion of the spectrum and into the near infrared. Within this overall wavelength range the two reflection scans noted above can be in the same or different wavelength regions, depending on the particular approach to scanning selected, but the third overall scan is in each instance required to be in a different wavelength region than the two reflection scans. Although the overall 300 to 900 nm scanning bandwidth leaves ample latitude for broad band scanning wavelengths, it is generally preferred that each scan be conducted over bandwidths that can be easily established using commercially available filters, typically 50 nm or less at half peak intensity. Laser scanning, of course, permits very narrow scanning bandwidths.

Beginning with the assumption that the support is transparent following photographic processing, the preferred scanning technique is to reflection scan Structure I from above (assuming the orientation shown above) the third emulsion layer unit at a wavelength the second interlayer is capable of absorbing to provide a record of the image in the third emulsion layer unit. The first emulsion layer unit Structure I is also reflection scanned from beneath the support at a wavelength the first interlayer is capable of absorbing to provide a record of the image in the first emulsion layer unit. The photographic element is then scanned through the support, the two interlayers and all emulsion layer units.

An important point to notice is that in the description of the interlayer properties required during imagewise exposure transparency of the interlayers to all wavelengths underlying emulsion layer units are intended to record is required, with light absorption, if any, being required only to prevent unwanted blue transmission to underlying minus blue recording emulsion layer units containing silver halides exhibiting native blue sensitivity. Only by additionally considering transmission and absorption requirements of the interlayers during scanning is a complete appreciation obtained of their absorption and transmission characteristics.

Taking LS-1 (B/IL2/G/IL1/R/S) as an example, if it is assumed that the hue of the interlayers remains substantially the same during imagewise exposure and scanning and it is further assumed that silver halides having significant native blue sensitivity are employed in each emulsion layer unit, the following transmission and absorption characteristics of the interlayers are possible: IL2 must absorb blue light and must transmit green and red light. Whether IL2 transmits or absorbs in the near ultraviolet and near infrared is entirely a matter of choice, depending on the specific scanning wavelengths chosen. A yellow dye that does not decolorize during photographic processing is a simple choice for IL2. A yellow dye combined with a near UV or near IR absorber, where reflection scanning is conducted outside the visible spectrum is another possible choice. IL1 must transmit red light during exposure and must absorb light in one of the near UV, blue, green and near IR portions of the spectrum during reflection scanning. To supplement IL2 in protecting R from blue light exposure it is preferred that IL1 also absorb in the blue. Hence, it is recognized that a simple and preferred film construction satisfying the requirements of the invention allows the same materials to be used to construct IL1 and IL2. For example, a permanent yellow dye can be present in both IL1 and IL2. Choosing IL1 and IL2 to absorb in the same region of the spectrum provides the further advantage that the same reflection scanner or similar reflection scanners can be used for both reflection scans. When IL1 and IL2 contain a yellow dye, any spectral region outside the blue can be selected for the third scan, and even when IL1 and IL2 absorb in two different spectral regions, all other spectral regions remain available for the third scan. For example, if IL2 contains a yellow dye and IL1 contains a magenta dye, the near UV, red and near IR regions remain available for the third scan.

Taking LS-3 (G/IL2/R/IL1/B/S) as another example, if it is assumed that the hue of the interlayers remains substantially the same during imagewise exposure and scanning and it is further assumed that silver halides lacking significant native blue sensitivity are employed in each emulsion layer unit, the following transmission and absorption characteristics of the interlayers are possible: To satisfy scanning requirements IL1 and IL2 must each absorb in one of the near UV, blue, green, red and near IR regions of the spectrum. To satisfy exposure requirements IL1 cannot absorb in the blue and IL2 cannot absorb in the red or blue. For the reasons noted above in the preferred construction IL1 and IL2 absorb in the same region of the spectrum. Thus, a permanent magenta dye is preferably incorporated in IL1 and IL2 with near UV absorbers or near IR absorbers being alternative choices. When IL1 and IL2 contain a magenta dye, the third scan can be conducted in any region of the spectrum, except the green. When IL1 and IL2 absorb in two different regions, all remaining regions are available for the third scan. For example, if IL2 contains a magenta dye and IL1 contains a cyan dye, the third scan can be efficiently conducted in the near UV or blue portions of the spectrum. Near IR scanning when IL1 contains a cyan dye is not preferred, since nominally cyan dyes also frequently exhibit significant near IR absorption.

In the discussion above three different scans have been referred to, two reflection scans and one transmission scan. It is appreciated that in terms of the actual mechanics of scanning the same light source can be used for simultaneously performing one of the reflection scans and the transmission scan. For example, assuming yellow interlayers IL1 and IL2, a white light source can be used to scan Structure I. The reflection scan information for the first or third emulsion layer unit is obtained by passing the reflected light through a blue filter. The portion of the white light that passes through Structure I can be passed through a yellow filter to obtain the transmission scan information. The same white light source can be used in a separate addressing sequence for the remaining reflection scan, again using a blue filter. When the absorption of the interlayers is varied, the absorptions of the filters are correspondingly varied. For example, with two magenta interlayers the reflection scan filters are green and the transmission filter is magenta. With one yellow and one magenta interlayer a blue filter is used to obtain reflection information from the emulsion layer unit nearest the yellow interlayer, a green filter is used to obtain reflection information from the emulsion layer unit nearest the magenta filter, and a red filter is used to obtain the transmission scan information.

In an alternative scanning technique the two reflection scans of differing wavelength regions are conducted from the same side of the photographic element. That is, both the reflection scans can be performed by addressing the emulsion layer units of Structure I from above the support (assuming the orientation shown above) or by addressing the emulsion layer units through the support, assuming a transparent support after photographic processing. When the support is transparent, the third scan is a transmission scan that can be conducted using a light source that is directed toward Structure I from either side. When the support is reflective (e.g., white) the third scan is conducted from the same side of the support as the two reflection scans. An advantage of performing the third scan on an element having a reflective support is that the scanning beam twice traverses the emulsion layer units and thereby provides a larger signal modulation.

Preferably all three scans are performed by addressing Structure I from the same side. The advantage of this approach is that the three scans can be conducted in any sequential or concurrent combination. For example, three separate light sources can be used to perform three separate scans concurrently. Alternatively, one light source can be used and filters can be used to supply each scan record selectively to the appropriate sensor. The advantages of this approach are that only one light source is required and the consolidation of all scans into one addressing operation greatly simplifies the task of spatial registration that forms an integral part of correlating pixel-by-pixel information from different scans. When all scanning is conducted from one side, the support can be either transparent or reflective. When the support is reflective, the light source or sources and all three sensors for the scan records are located above Structure I. In all forms of the invention, when the scans are conducted sequentially, it is possible to use the same sensor for successive scans.

Taking LS-1 (B/IL2/G/IL1/R/S) as an example for illustrating three reflection scans of differing wavelengths from the same side of the photographic element when it contains a reflective support, if it is assumed that the hue of the interlayers remains substantially the same during imagewise exposure and scanning and it is further assumed that silver halides having significant native blue sensitivity are employed in each emulsion layer unit, the following transmission and absorption characteristics of the interlayers are possible: IL2 can take any form previously described for reflection scanning from opposite sides of the support, except that in this instance IL2 must be capable of transmitting light in two other regions of the spectrum, instead of just one. A yellow dye that does not decolorize during photographic processing is a simple choice for IL2. Since IL2 must transmit light during two other scans, it is preferred to limit the absorption of IL2 to the blue region of the spectrum. IL1 must transmit red light during exposure and must absorb light in one region of the spectrum other than the blue during scanning. In one preferred form IL1 contains a magenta dye. In another preferred form IL1 can supplement IL2 in protecting R from blue light exposure and also absorb in the blue. In this form IL1 can absorb blue and green-that is, IL1 can contain a red dye or a mixture of yellow and magenta dyes. When IL1 transmits red and absorbs green light and IL2 absorbs blue light, the third scan can be conducted in the red portion of the spectrum or outside the visible spectrum in the near UV or near IR. The spectral adjacency of the near IR and red regions of the spectrum make these two most attractive for use separately or together for the third scan.

Taking LS-3 (G/IL2/R/IL1/B/S) as another example of performing three reflection scans of a photographic element containing a reflective support, if it is assumed that the hue of the interlayers remains substantially the same during imagewise exposure and scanning and it is further assumed that silver halides lacking significant native blue sensitivity are employed in each emulsion layer unit, the following transmission and absorption characteristics of the interlayers are possible: To satisfy exposure requirements IL2 must transmit red and blue light and to satisfy scanning requirements IL2 must absorb in at least one other region of the spectrum. Therefore, in a preferred form IL2 contains a magenta dye. A near UV or near IR absorber can be substituted for the magenta dye, but are not preferred. To satisfy exposure requirements IL1 must transmit blue light, and to satisfy scanning requirements IL1 must absorb light in a wavelength region other than the blue and must further absorb light in a wavelength region in which IL2 does not absorb light. Thus, when IL2 contains a magenta dye, IL1 preferably contains a cyan dye and/or a near IR absorber. The third scan can be performed in any spectral wavelength region in which IL1 and IL2 are transmissive. For example, when IL1 contains a cyan dye and IL2 contains a magenta dye, the third scan is preferably performed in the blue and/or near UV portions of the spectrum.

In performing three reflection scans from above Structure I (as shown above) a first scan wavelength is absorbed by IL2, and the light reflected from the third emulsion layer unit provides a record of the imagewise exposure of the third emulsion layer unit only. A second scan wavelength is absorbed by IL1, and the reflected light from the second and third emulsion layer units is recorded. This provides a combined record of the image patterns in the second and third emulsion layers. By comparing the first and second scans the image within the second emulsion layer unit can be obtained. The third scan provides a record of the attentuation of light passing twice through all of the emulsion layer units. The information obtained by the third scan is then a combined image record of all the emulsion layer units. By comparing the combined record with the records from the previous scans an image corresponding to that of the first emulsion layer unit alone can be obtained.

It is possible to perform the three reflection scans described above using a photographic element with a transparent support. The transparent support is placed in optical contact with a reflective backing during at least the third scan. With a transparent support it is also possible to perform two reflection scans from above the support as described while performing the third scan as a transmission scan. Still another option is to perform two reflection scans through a transparent support or three reflection scans through a transparent support when the third emulsion layer unit is mounted in optical contact with a reflective backing. This restricts the interlayer dye selections slightly, but still allows the preferred interlayer dyes to be employed. For example, assuming visible spectrum scanning only, in this instance the preferred subtractive primary interlayer dye selections are still available, but additive primary dye selections are precluded.

From the foregoing detailed description of specific interlayer choices for LS-1 and LS-3, the photographically most attractive layer sequences for emulsions having and lacking, respectively, significant native blue silver halide sensitivity, the specific interlayer selections for the remaining possible layer sequences LS-2, LS-4, LS-5 and LS-6 are apparent by analogy.

In the foregoing description of interlayer transmission and absorption characteristics discussion has been directed to spectrally passive interlayers—that is, interlayers that retain substantially the same hue during exposure and after photographic processing. It is recognized that the photographic elements can alternatively incorporate spectrally active interlayers—that is, interlayers that alter their absorption and transmission characteristics between imagewise exposure and scanning. For layer sequences employing silver halides that lack significant native blue sensitivity it is recognized that no interlayer absorption is required during imagewise exposure and that any absorption properties introduced after imagewise exposure and before scanning can include not only the absorptions described above but in addition all absorptions that are compatible with scanning. Stated another way, absorptions that are incompatible with imagewise exposure can be introduced after imagewise exposure. When employing spectrally active interlayers in a photographic element with a transparent support intended to be reflection scanned from opposite sides, interlayers IL1 and IL2 can be transparent throughout the visible spectrum during imagewise exposure and before scanning can be transmissive only in one common wavelength region of the spectrum. When employing spectrally active interlayers in a photographic element intended to be reflection scanned from only one side of its support, interlayers IL1 and IL2 can be transparent throughout the visible spectrum during imagewise exposure and before scanning both interlayers can be transmissive in one common wavelength region of the spectrum with one of the interlayers also being transmissive in a spectral region in which the remaining interlayer is absorptive. When silver halides are employed that exhibit significant native blue sensitivity, the spectrally active interlayers should exhibit the blue light absorption characteristics described above for protecting against unwanted blue light exposures, but the blue light absorption characteristics need not be retained after imagewise exposure, except to the extent relied upon to provide required absorption for scanning. For example, an initially yellow interlayer dye that is spectrally active may be spectrally shifted in hue to become a magenta, cyan, blue, red or green dye before scanning.

The spectrally active interlayers can be constructed by any one of a variety of conveniently available conventional techniques. For example, leuco dyes incorporated in the interlayers in an initially colorless or yellow form can be rendered highly absorptive in another region of the spectrum during or following photographic processing. Alternatively, a mobile dye can be introduced into the photographic element during processing and mordanted within the interlayers. Another alternative is to incorporate in the interlayers indicator dyes that can be spectrally switched by pH adjustment of the photographic element during or following photographic processing. Yet another variation is to incorporate dye-forming couplers in the interlayers along with an oxidizing agent, such as prefogged silver halide grains, so that upon photographic processing using a color developing agent dyes are created by coupling within the interlayers.

Conventional scanning techniques satisfying the requirements described above can be employed, including point-by-point, line-by-line and area scanning, and require no detailed description. A simple technique for scanning is to scan the photographically processed element point-by-point along a series of laterally offset parallel scan paths. The intensity of light reflected from or passing through the photographic element at a scanning point is noted by a sensor which converts radiation received into an electrical signal. The electrical signal is passed through an analogue to digital converter and sent to memory in a digital computer together with locant information required for pixel location within the image. Signal comparisons and mathematical operations to resolve scan records that represent combinations of two or three different images can be undertaken by routine procedures once the information obtained by scanning has been placed in the computer.

Once the image records corresponding to the latent images have been obtained, the original image or selected variations of the original image can be reproduced at will. The simplest approach is to use lasers to expose pixel-by-pixel a conventional color paper. Simpson et al U.S. Pat. No. 4,619,892 discloses differentially infrared sensitized color print materials particularly adapted for exposure with near infrared lasers. Instead of producing a viewable hard copy of the original image the image information can instead be fed to a video display terminal for viewing or fed to a storage medium (e.g., an optical disk) for archival storage and later viewing.

When developed silver is employed for light reflectance and reflection scanning is undertaken in the blue region of the spectrum, Carey Lea silver (CLS), which is yellow, can be incorporated in the interlayers in place of yellow dye to provide interlayer absorption characteristics. It is also possible to incorporate CLS for its known blue exposure protection in IL2 and/or IL1, to bleach the CLS from the photographic element along with developed silver and to rely on any one of the other techniques described above for the required absorption by the interlayers following photographic processing.

In the description of absorption, reflection and transmission characteristics it must be borne in mind that these are relative terms. Only a few materials absorb or reflect at invariantly high or low levels throughout the entire 300 to 900 spectral region of general interest. Therefore, absorption, reflection and transmission must be related to the specific spectral region of interest for a particular operation, such as exposure or scanning. Although the invention relies upon the reflectance of silver or silver halide to provide the scanning record, only a fraction of the light received by either of these materials is reflected. For silver halide reflectances typically vary from about 10 to 30 percent, depending on grain size and form and scanning wavelengths. Although silver halide reflectance can be maximized by grain selection, typically a mixture of grain sizes and shapes produce an average reflectance between the extremes noted above. As previously noted, developed silver exhibits significantly lower reflectance than silver halide, but the reflectance shows very little spectral variance. The interlayers which provide the background when the reflectances of silver or silver halide are scanned exhibit negligible refractive index differences from the emulsion vehicles and are preferably matched to the emulsion layer unit vehicle refractive indices. They therefore exhibit negligible, if any, reflection during reflection scanning. The light absorption and transmission efficiencies of the interlayers can be comparable to the efficiencies of blue absorbing interlayers in conventional photographic elements. Absorption and transmission efficiencies as low as 25 percent can be tolerated, but are preferably greater than 50 percent. The photographic element is constructed so that each emulsion layer unit receives at least a quarter and preferably greater than half of the available light it is intended to record. During scanning the intensities of the light sources can be adjusted to compensate for absorption and/or transmission inefficiencies. During reflection scanning the addressed interlayer preferably absorbs at least a quarter and most preferably more than half of the light received within the wavelength region of scanning. During transmission scanning preferably at least a quarter and most preferably at least half of the light penetrates the photographic element in minimum density areas.

One of the challenges encountered in producing images from information extracted by scanning is that the number of pixels of information available for viewing is only a fraction of that available from a comparable classical photographic print. It is therefore even more important in scan imaging to maximize the quality of the image information available from each pixel. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. Although the invention is described in terms of point-by-point scanning, it is appreciated that conventional approaches to improving image quality are contemplated. Illustrative systems of scan signal manipulation, including techniques for maximizing the quality of image records, are disclosed by Bayer U.S. Pat. No. 4,553,165, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. No. 4,694,342, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. No. 4,920,501, Kimoto et al U.S. Pat. No. 4,929,979, Klees U.S. Pat. No. 4,962,542, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Sullivan et al U.S. Pat. No. 5,070,413, Bowers et al U.S. Pat. No. 5,107,346, Telle U.S. Pat. No. 5,105,266, MacDonald et al U.S. Pat. No. 5,105,469, and Kwon et al U.S. Pat. No. 5,081,692, the disclosures of which are here incorporated by reference.

The multicolor photographic elements and their photographic processing, apart from the specific required features described above, can take any convenient conventional form. A summary of conventional photographic element features as well as their exposure and processing is contained in *Research Disclosure,* Vol. 308, December 1989, Item 308119, and a summary of tabular grain emulsion and photographic element features and their processing is contained in *Research Disclosure,* Vol. 225, December 1983, Item 22534, the disclosures of which are here incorporated by reference.

EXAMPLES

The invention can be better appreciated by reference to the following specific examples. In each of the examples coating densities, set out in brackets ([ ]) are reported in terms of grams per square meter (g/m$^2$), except as specifically noted. Silver halide coverages are reported in terms of silver. All emulsions were sulfur and gold sensitized and spectrally sensitized to the spectral region indicated by the layer title. Filter dye and oxidized developer scavenger were dispersed in gelatin solution in the presence of approximately equal amounts of supplemental solvents, such as tricresyl phosphate, dibutyl phthalate, or diethyl lauramide.

EXAMPLE 1

A color recording film having blue-absorbing interlayers according to the invention was prepared by coating the following layers in order on cellulose triacetate film base. The silver halide emulsions used were of the tabular grain type except where otherwise stated, and were silver bromoiodide having between 1 and 6 mol % iodide.

Layer 1: Gelatin underlayer
Gelatin [1.0]
Layer 2: Red-sensitive layer
Gelatin [1.0]
Fast red-sensitized emulsion [0.22] (grain diameter 1.5 μm, thickness 0.11 μm)
Mid-speed red sensitive emulsion [0.15] (grain diameter 0.72 μm, thickness 0.11 μm)
Slow red-sensitive emulsion, [0.20] (grain diameter 0.28 μm, non-tabular)
Scavenging agent A, [0.2] (see below)
Layer 3: Interlayer
Gelatin [1.5]
Yellow filter dye Y [0.225] (Calco Oil Yellow ENC TM, 15% by weight solution in diethyl lauramide)
Layer 4: Green-sensitive layer
Gelatin [2.0]
Fast green-sensitive emulsion [0.8] (grain diameter 1.5 μm, thickness 0.11 μm)
Mid-speed green-sensitive emulsion [0.4] (grain diameter 0.7 μm, thickness 0.11 μm)
Slow green-sensitive emulsion [0.6] (grain diameter 0.28 μm, non-tabular)
Scavenging agent A, [0.30]
Layer 5: Interlayer
Gelatin [1.5]
Yellow filter dye Y [0.225]
Layer 6: Blue sensitive layer
Gelatin [1.5]
Fast blue-sensitive emulsion [0.20] (grain diameter 1.39 μm, thickness 0.11 μm)
Mid-speed blue-sensitive emulsion [0.08] (grain diameter 0.72 μm, thickness 0.084 μm)
Slow blue-sensitive emulsion [0.08] (grain diameter 0.32 μm, thickness 0.072 μm)
Scavenging agent A [0.10]
Hardener bis(vinylsulfonyl)methane [0.19]
Layer 7: Supercoat
Gelatin [1.5]
Scavenging agent A has the following formula:

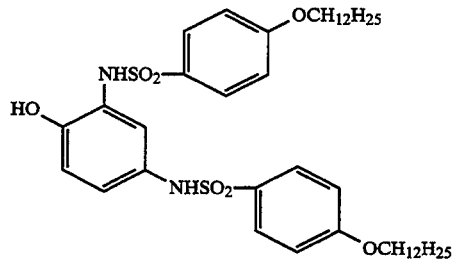

Also present in every emulsion-containing layer were 4-hydroxy-6-methyl-l,3,3A,7-tetraazaindene, sodium salt, at 1.25 g per mole of silver, 2-octadecyl-sulfohydroquinone, sodium salt, at 2.4 g per mole of silver, and the usual surfactants employed to aid the coating operation.

A sample of the film was sensitometrically exposed to white light through a graduated density step wedge, and other samples were exposed through a graduated density step wedge to light which had been filtered through Wratten TM 29, 74 and 98 filters, to give red, green and blue exposures, respectively. The film samples were then developed for three minutes in the following developer solution at 25° C.:

| | |
|---|---|
| Phenidone TM | 0.2 g/L |
| ascorbic acid | 7.0 g/L |
| $Na_2CO_3$ | 30 g/L |
| NaBr | 1.0 g/L |
| Water to 1 liter | |

pH adjusted to 10.0 with dilute sulfuric acid.

The samples were then placed for 30 seconds in a stop bath of 2% acetic acid in water, then soaked for 5 minutes in a 25 gram per liter aqueous solution of 4-hydroxy-6-methyl-1,3,3a,7-tetraazaindene, sodium salt, rinsed in water and dried.

The densities of the developed step images were then measured by scanning with a densitometer as follows:

- the reflection density through a Status M blue filter, measured at the top of the film (designated URf, for Upper Reflection);
- the reflection density through a Status M blue filter, measured through the film base (designated LRf, for Lower Reflection); and
- the transmission density through a Status M red filter (designated TT, for Total Transmission).

Minimum URf, LRf, and TT responses measured for unexposed samples of photographically processed film are designated URfmin, LRfmin, and TTmin, respectively. The following values were found:

URfmin=1.48

LRfmin=1.68

TTmin=0.61.

A second set of responses (URf2, LRf2, and TT2) were determined by subtracting URfmin, LRfmin, and TTmin from URf, LRf, and TT, respectively for each exposure level of the photographically processed film strips;

URf2=URf−URfmin

LRf2=LRf−LRfmin

TT2=TT−TTmin.

Table I shows the URf2, LRf2, and TT2 responses determined for the film strip that received the blue separation exposure.

TABLE I

| Relative Log Exposure | TT2 | URf2 | LRf2 |
|---|---|---|---|
| 0.0 | 0.00 | 0.00 | 0.00 |
| 0.2 | 0.00 | 0.00 | 0.01 |
| 0.4 | 0.00 | 0.00 | −0.03 |
| 0.6 | 0.00 | 0.00 | 0.02 |
| 0.8 | 0.00 | 0.00 | 0.07 |
| 1.0 | 0.00 | 0.00 | 0.03 |
| 1.2 | 0.01 | 0.00 | 0.01 |
| 1.4 | 0.03 | 0.02 | −0.01 |
| 1.6 | 0.05 | 0.02 | 0.00 |
| 1.8 | 0.09 | 0.04 | 0.00 |
| 2.0 | 0.13 | 0.07 | 0.02 |
| 2.2 | 0.17 | 0.09 | 0.01 |
| 2.4 | 0.21 | 0.13 | −0.01 |
| 2.6 | 0.27 | 0.14 | 0.00 |
| 2.8 | 0.33 | 0.18 | −0.01 |
| 3.0 | 0.40 | 0.23 | 0.01 |

A plot was made of TT2 versus URf2 for all levels of the blue separation exposure. A best fit line satisfying the relationship:

$$TT2=a\times URf2$$

was determined either graphically or by standard methods of linear regression over the range of the plot that was substantially linear. A value of 1.804 was found for a. The data in Table I indicates that development in the blue recording layer unit coated farthest from the support does not produce a LRf2 response.

Table II shows the corrected responses for the red separation exposure.

TABLE II

| Relative Log Exposure | TT2 | URf2 | LRf2 |
|---|---|---|---|
| 0.0 | 0.00 | 0.00 | 0.00 |
| 0.2 | 0.00 | 0.02 | 0.01 |
| 0.4 | 0.01 | 0.01 | 0.02 |
| 0.6 | 0.03 | 0.02 | 0.03 |
| 0.8 | 0.07 | 0.00 | 0.04 |
| 1.0 | 0.10 | 0.01 | 0.10 |
| 1.2 | 0.12 | 0.02 | 0.14 |
| 1.4 | 0.15 | 0.02 | 0.17 |
| 1.6 | 0.18 | 0.02 | 0.19 |
| 1.8 | 0.21 | 0.02 | 0.23 |
| 2.0 | 0.24 | 0.01 | 0.29 |
| 2.2 | 0.26 | 0.00 | 0.31 |
| 2.4 | 0.28 | 0.00 | 0.35 |
| 2.6 | 0.30 | 0.01 | 0.39 |
| 2.8 | 0.32 | 0.01 | 0.43 |
| 3.0 | 0.34 | 0.00 | 0.49 |

A plot was made of TT2 versus LRf2 for all levels of the red separation exposure. A best fit line satisfying the relationship:

$$TT2=b\times LRf2$$

was determined either graphically or by standard methods of linear regression over the range of the plot that was substantially linear. A value of 0.589 was found for b. The data in Table II indicates that development in the red recording layer unit coated closest to the support does not produce a URf2 response.

Table III shows the corrected responses for the green separation exposure.

TABLE III

| Relative Log Exposure | TT2 | URf2 | LRf2 |
|---|---|---|---|
| 0.0 | 0.00 | 0.00 | 0.00 |
| 0.2 | 0.00 | 0.01 | −0.02 |
| 0.4 | 0.00 | 0.00 | 0.02 |
| 0.6 | 0.01 | 0.01 | −0.01 |
| 0.8 | 0.04 | 0.00 | −0.01 |
| 1.0 | 0.11 | 0.02 | 0.01 |
| 1.2 | 0.21 | 0.01 | −0.03 |
| 1.4 | 0.34 | 0.02 | 0.00 |
| 1.6 | 0.45 | 0.02 | −0.03 |
| 1.8 | 0.54 | 0.02 | −0.01 |
| 2.0 | 0.63 | 0.01 | 0.00 |
| 2.2 | 0.74 | 0.02 | 0.02 |
| 2.4 | 0.82 | 0.02 | 0.01 |
| 2.6 | 0.91 | 0.01 | 0.04 |
| 2.8 | 1.00 | 0.03 | 0.10 |
| 3.0 | 1.07 | 0.02 | 0.11 |

The data in Table III indicates that development in the green recording layer unit coated intermediate in the film structure does not produce a URf2 response. Similarly, there is no LRf2 response until the green light exposure reaches sufficient levels to "punch through" and produce development in the red recording layer unit and a corresponding LRf2 response.

From these measurements, relationships between the blue reflection densities and the red transmission densities of the top and bottom layers were obtained:

- BT (red transmission density from the blue-sensitive layer)=a×URf2=1.804×URf2
- RT (red transmission density from the red-sensitive layer)=b×LRf2=0.589×LRf2

Since image densities are additive, the red transmission density of the middle, green recording layer, GT is simply given by $$GT = TT2 - BT - RT$$
$$= TT2 - (1.804 \times URf2) - (0.589 \times LRf2).$$

Table IV shows the determined responses for the photographically processed film strip that received a neutral exposure.

TABLE IV

| Relative Log Exposure | GT | URf2 | LRf2 |
|---|---|---|---|
| 0.0 | 0.00 | 0.00 | 0.00 |
| 0.2 | −0.02 | 0.01 | 0.01 |
| 0.4 | −0.02 | 0.01 | 0.00 |
| 0.6 | −0.02 | 0.03 | 0.00 |
| 0.8 | 0.00 | 0.04 | 0.00 |
| 1.0 | 0.11 | 0.05 | 0.02 |
| 1.2 | 0.22 | 0.06 | 0.07 |
| 1.4 | 0.30 | 0.08 | 0.14 |
| 1.6 | 0.41 | 0.09 | 0.17 |
| 1.8 | 0.43 | 0.13 | 0.19 |
| 2.0 | 0.50 | 0.15 | 0.23 |
| 2.2 | 0.54 | 0.18 | 0.25 |
| 2.4 | 0.59 | 0.20 | 0.25 |
| 2.6 | 0.58 | 0.25 | 0.29 |
| 2.8 | 0.58 | 0.29 | 0.31 |
| 3.0 | 0.54 | 0.35 | 0.35 |

Plots were made of GT, URf2, and LRf2 values versus relative log exposure given the film. These plots relate input exposure with the film response originating in each individual film record of the photographic element. Input exposure values determined for each pixel of a film sample exposed and processed following the procedures described above are used to drive a digital display device yielding a full color, photographic reproduction of the original scene.

The invention has been described in detail with particular reference to preferred embodiments thereof, but it will be understood that variations and modifications can be effected within the spirit and scope of the invention.

What is claimed is:

1. A photographic element comprised of a support and, coated on the support, a sequence of superimposed blue, green and red recording silver halide emulsion layer units that are each chosen to record imagewise exposure in a different one of the blue, green and red portions of the spectrum and each of which produce images of the same hue as the remaining of the silver halide emulsion layer units upon processing, one of the emulsion layer units forming a first emulsion layer unit in the sequence coated nearest the support, another of the emulsion layer units forming a last emulsion layer unit in the sequence coated farthest from the support, and an intermediate emulsion layer unit located between the first and last emulsion layer units, and a first interlayer coated between the first emulsion layer unit and the intermediate emulsion layer unit capable of transmitting to the first emulsion layer unit electromagnetic radiation the first emulsion layer unit is intended to record and a second interlayer coated between the intermediate emulsion layer unit and the last emulsion layer unit capable of transmitting to the first and intermediate emulsion layer units electromagnetic radiation the first and intermediate emulsion layer units are intended to record,

WHEREIN the first interlayer contains a dye or a precursor of a dye capable of absorbing after photographic processing scanning radiation within at least a first wavelength region and the second interlayer contains a dye or a precursor of a dye capable of absorbing after photographic processing scanning radiation within at least the first wavelength region or a second wavelength region.

2. A photographic element according to claim 1 wherein the last emulsion layer unit is chosen to record imagewise exposure in the blue portion of the spectrum and the first and second interlayers each contain a yellow dye or a precursor of a yellow dye capable of absorbing after photographic processing blue scanning radiation.

3. A photographic element according to claim 1 wherein the last emulsion layer unit is chosen to record imagewise exposure in the blue portion of the spectrum, the intermediate emulsion layer unit is chosen to record imagewise exposure in the green portion of the spectrum, and the first emulsion layer unit is chosen to record imagewise exposure in the red portion of the spectrum, the second interlayer contains a yellow dye or a precursor of a yellow dye capable of absorbing after photographic processing blue scanning radiation, and the first interlayer contains a magenta dye or a precursor of a magenta dye capable of absorbing after photographic processing green scanning radiation.

4. A photographic element according to claim 11 wherein the support is chosen to be transparent following photographic processing.

5. A photographic element according to claim 1 wherein the support is chosen to be reflective following photographic processing.

6. A photographic element according to claim 1 wherein the intermediate and last recording emulsion layer units are chosen to exhibit minimal sensitivity to the blue region of the spectrum, the last emulsion layer unit is the recording layer unit chosen to record imagewise exposure in the green portion of the spectrum, the second interlayer contains a magenta dye or a precursor of a magenta dye capable of absorbing after photographic processing green scanning radiation, the intermediate emulsion layer unit is the recording layer unit chosen to record imagewise exposure in the red portion of the spectrum, the first interlayer contains a cyan or magenta dye or a precursor of a cyan or magenta dye capable of absorbing after photographic processing red or green scanning radiation, and the first emulsion layer unit is the recording layer unit chosen to record imagewise exposure in the blue portion of the spectrum.

* * * * *